United States Patent [19]

Eidem

[11] Patent Number: 4,618,373

[45] Date of Patent: Oct. 21, 1986

[54] AIR-BLOWING ASPHALT USING HYDROHALIC ACID CATALYSTS

[75] Inventor: Penny K. Eidem, Novato, Calif.

[73] Assignee: Chevron Research Company, San Francisco, Calif.

[21] Appl. No.: 584,428

[22] Filed: Feb. 28, 1984

[51] Int. Cl.[4] ..... C08L 95/00

[52] U.S. Cl. ..... 106/273 R; 208/22; 208/44

[58] Field of Search ..... 106/273 R; 208/22, 23, 208/44

[56] References Cited

U.S. PATENT DOCUMENTS 2,200,914 5/1940 Burk et al. ..... 208/4

*Primary Examiner*—Amelia B. Yarbrough

*Attorney, Agent, or Firm*—S. R. LaPaglia; R. C. Gaffney; J. J. DeYoung

[57] ABSTRACT

A process for air-blowing asphalt in the presence of hydrohalic acids, particularly hydrobromic acid, and an asphalt composition comprising a major amount of asphalt and a minor but effective amount of hydrohalic acid is disclosed.

17 Claims, No Drawings

AIR-BLOWING ASPHALT USING HYDROHALIC ACID CATALYSTS

BACKGROUND OF THE INVENTION

The present invention discloses an asphalt composition suitable for use in air blowing and the process of air blowing the same, both using hydrohalic acids, particularly hydrobromic acid, as catalysts.

Air-blowing of asphalt is a process by which stock asphalt is converted to an asphalt product having more desirable properties by the forced introduction of air by blowing at temperatures ranging from 300° F. to 600° F. In its unprocessed forms, asphalt may be unsuitable for particular applications due to excessive hardness or a too low softening point. The degree of hardness is referred to as penetration. The modification of the softening point/penetration properties by air blowing permits the manufacture of the aspahlt to specifications otherwise not possible. These products are called "Industrial or Roofing Asphalts". Desirable properties for Industrial Asphalts are given in ASTM D312-78. Additionally, it is well known that the use of a catalyst during air blowing further improves the softening point/penetration relationship of the asphalt. Catalyst use also reduces the time required to bring the asphalt to the desired softening point, a significant economic benefit.

Commonly used and well-known air-blowing catalysts, many of which have been patented, include ferric chloride, $FeCl_3$, U.S. Pat. No. 1,783,186, phosphorous pentoxide, $P_2O_5$, U.S. Pat. No. 2,450,756, aluminum chloride, $AlCl_3$, U.S. Pat. No. 2,200,914, boric acid, U.S. Pat. No. 2,375,117, copper sulfate $CuSO_4$, zinc chloride $ZnCl_2$, phosphorous sesquesulfide, $P_4S_3$, phosphorous pentasulfide, $P_2S_5$ and phytic acid, $C_6H_6O_6(H_2PO_3)_6$. Also useful as catalysts are phosphoric acid $H_3PO_4$ and ferrous chloride $FeCl_2$, U.S. Pat. No. 4,338,137, sulfonic acid U.S. Ser. No. 445,400, now U.S. Pat. No. 4,440,579, and alkali metal hydroxides, U.S. Ser. No. 537,892 now abandoned. By far, the most useful and commonly used of the catalysts are ferric chloride and phosphoric acid.

The primary reason for the popularity of $FeCl_3$ and $H_3PO_4$ is the fact that they are readily obtained and relatively inexpensive to use. They do, however, have serious drawbacks. In particular, the use of ferric chloride as a catalyst contributes to two negative characteristics of the asphalt which raise problems in meeting desired specifications. One characteristic, called skinning, results from the heating of industrial asphalts in the presence of air at elevated temperatures. A tough, insoluble skin is formed on the surface of the asphalt which is extremely insoluble in the asphalt itself. This skin causes problems both to the refiner and the asphalt customer. It has been found that the skinning tendency of the asphalt increases when ferric chloride is used as the catalyst in air blowing.

A second undesirable characteristic resulting from the use of ferric chloride catalysts is known as "fallback". Fallback is a drop in the softening point which air-blown asphalt may undergo when held at a stable elevated temperature in an oxygen-depleted atmosphere. When asphalt is held over time at elevated temperatures, the softening point/penetration ratio reduces or "falls back" outside of the desired specification range even though it is being held at a constant temperature.

This may be caused or aggravated by various mixture components, particularly $FeCl_3$.

SUMMARY OF THE INVENTION

The present invention comprises an air-blown asphalt composition comprising asphalt and a catalytic amount of a hydrohalic acid and a process for producing said composition. The hydrohalic acid, when used in air-blown asphalt, increases the penetration, at a given softening point resulting in a more industrially desirable asphalt composition. It also allows the use of less desirable crude stocks. Additionally, the catalyst causes the air-blowing reaction to proceed at a faster rate, thereby reaching the desired softening point sooner than without the catalyst.

The hydrohalic acids employed in the present invention can include hydrochloric acid (HCl), hydrobromic acid (HBr), and hydriodic acid (HI). The most preferred, for purposes of this invention, is hydrobromic acid, HBr. The catalytic amount of hydrohalic acid varies with a number of factors, including the acid used, the crude asphalt feedstock, and the temperature and other physical parameters. In general, however, the desired amount ranges from 0.15 percent by weight to 5.0 percent by weight, and the preferred range is about 0.25 weight percent to about 2.5 weight percent.

DETAILED DESCRIPTION OF THE INVENTION

Hydrohalic acids are introduced into asphalt as a catalyst for air blowing. The hydrohalic acids are added in an amount from about 0.15 weight percent to about 5.0 weight percent of the total catalyzed asphalt composition. In the preferred embodiment of the invention the hydrohalic acid catalyst comprises from about 0.25 weight to about 2.5 weight percent of the total composition. The hydrohalic acids accelerate the speed with which the air-blowing reaction proceeds to the desired specifications. This results in equivalent or higher penetrations at the desired softening point than with other catalysts, and gives a considerably higher penetration than with no catalyst. Additionally, the hydrohalic acid catalysts minimize skinning and fallback tendencies of the asphalt.

The asphalt stock suitable for use can be of varied character. Any petroleum residua or flux, remaining following the separation of vaporizable hydrocarbons through lubricating oil fractions or any relatively high molecular weight extract obtained from petroleum refining or from virgin, naturally occurring asphalt can be used. For example the residua from Alaskan North Slope crude, Arabian Heavy crude, Arabian Light crude, and the like, can be used. Of course, the difference in the asphalt stock will result in different properties in the finished air-blowing asphalt. However, in general, the catalysts of the present invention allow the use of lower penetration crude asphalt feeds to the air-blowing process, and still produce highly satisfactory "Industrial Asphalts".

The hydrohalic acids finding use in this invention include hydrochloric, hydrobromic, and hydriodic, with hydrobromic being the most preferred Surprisingly, of the three acids, hydrobromic is the most effective. At the temperatures tested, catalytic activity at 0.5 weight percent follows the order HBr > HI > HCl. This is not a reflection of acid concentration on a molar basis, as that decreases in the order HCl > HBr > HI. The effectiveness ranking is also inconsistent with regard to acid strength with proceeds HI>HBr>HCl. Furthermore, it is surprising that any of the hydrohalides have catalytic effects since all of these compounds are gases at the air-blowing temperatures, and would be expected to be easily swept out of the system by the gas flow.

The composition is formulated by heating asphalt to a temperature of about 200° F. to 350° F. and thoroughly mixing the hydrohalic acid catalyst in the asphalt prior to air blowing. The acids may be introduced in any convenient form, either as an aqueuos solution or as a gas, with the aqueous solution being preferred. Thereafter, the asphalt-hydrohalic acid composition is air-blown in accordance with procedures known in the art, such as those taught in U.S. Pat. Nos. 2,450,756, 2,762,755, and 3,126,329, said patents incorporated herein by reference.

More specifically, the asphalt is heated to a temperature of from about 300° F. to about 600° F., preferably 350° F. to 500° F. and air, oxygen or an oxygen-inert gas mixture is bubbled or blown through the composition at a rate of from about 2 to about 15 cubic feet/hour/gal of asphalt, for sufficient time to achieve a desired softening point. Generally, the air-blowing operation is carried out for a period of from about 0.5 hour to about 12 hours, preferably from 0.5 hour to about 5 hours.

The product produced by air-blowing asphalt in the presence of the catalysts of this invention leads to products having a higher softening point and a lower penetration than the asphalt feedstock. Desirable Industrial Asphalt products having softening points ranging from 115° F. to 240° F., preferably from 215° F. to 235° F. Penetration as measured at 77° F. ranges from 10 ddm to b 90 ddm, preferably from 15 ddm to 30 ddm.

Having described the invention, the following examples are intended to be illustrative and not limit the scope of the invention.

Additionally, the following examples were carried out in two different but related apparatus systems. In one, the so-called "mini-still", a laboratory scale situation was used, employing approximately 250 to 300 grams of the asphalt material. When using the mini-still apparatus, it is diffuclt to determine the softening point until after the run is complete. As a consequence, the data from these runs is used to calculate the results at a 220° F. softening point for comparison purposes, as given in Table I. These calculations are based on the method of R. N. Kinnaird, Jr. [Proceedings of the Association of Asphalt Paving Tech. Vol. 26, 174–189 (Feb. 1957)]. In the second, a pilot plant scale asphalt-turbo-still, an approximately 3000-gram capacity sample was employed. In this apparatus, control over the final softening point is much better and runs gave products having a softening point near 220° F. as shown in Table II. However, the procedure of Kinnaird was also applied to these results for comparison as shown in Table III. The two procedures correlated well and their results are as illustrated in the tables following the examples.

EXAMPLES

With Mini-Still

In these examples, the mini-still apparatus was employed using a Glas-Col heating mantle surrounding a one quart metal container, a heat control unit with thermocouple, a stirrer with Cowles blade attached, and an air supply connected to a ⅛ inch air line into the air-blowing container. 250 Grams of asphalt containing the desired weight percent of catalyst was placed in the one-quart metal container and covered with aluminum foil. The container and contents were heated to 325° F. for approximately one hour. The stirrer and air line were introduced into the container with the stirrer placed such that the Cowles blade just misses touching the bottom of the container. The stirring was begun and the temperature controller was increased to 400° F. A nitrogen line was introduced through the container cover, blanketing the surface of the asphalt with inert nitrogen gas. The stirrer was set at a speed such that turbulence and oxidation were introduced into the asphalt flux mixture, contributing to the air-blown effect. The temperature was gradually increased to 450° F. and the speed of the stirrer set at approximately 850 rpm. Air was introduced at approximately 120 cc per minute (one-half of the air rate used in the turbo-still). At different times during the run, samples were taken for softening point and penetration analysis.

Runs were carried out in accordance with this procedure using hydrobromic acid, hydrochloric acid, and hydriodic acid at various concentrations and various temperatures. Ferric chloride and no catalyst were also tested for comparison.

With Turbo-Still

Additionally, various other crude stocks were tested in pilot plant runs using hydrobromic acid, and ferric chloride and no catalyst for comparison. These asphalt fluxes were Arabian Light, Arabian Heavy and Alaskan North Slope blend 1 and 2. The procedure was as follows:

A 3000-gram capacity asphalt turbo still pilot plant was used which employs a temperature control vessel fitted with high speed rotostatic mixer providing excellent contact with injected air. The metered air was injected by tubing passing through the temperature-controlled asphalt and discharged directly below the mixer located at the bottom of the vessel. The still was also provided with an overflow vent for offgases and entrained material and has a sampling and drain valve through which samples were taken. The runs in the asphalt turbo-still pilot plant were conducted in essentially the same manner as those in the mini-still. Penetration, viscosity and softening point were measured, as a function of time.

The results of these various examples and comparative examples are summarized in Table I for the mini-still runs, and Table II for the Pilot Plant turbo-still runs. Additionally, various calculable parameters for the pilot plant turbo-still runs were calculated and are summarized in Table III.

TABLE I

MINI-STILL AIR-BLOWING RUNS USING ALASKAN NORTH SLOPE ASPHALT[1]

| Run No. | Air-Blowing Temp., °F. | Wt % Catalyst | Decimoles Catalyst | Reaction Time Min | Softening Point °F. | Penetration (77° F.) dmm | Calculated For A 220° F. Softening Point: Rx Time[2] Min | Calculated For A 220° F. Softening Point: Penetration (77° F.)[3] dmm |
|---|---|---|---|---|---|---|---|---|
| 1 | 450 | None | — | 140 | 174 | 19 | 189 | 10 |
| 2 | 450 | 0.35 $FeCl_3$ | 0.54 | 80 | 219 | 14 | 78 | 14 |
| 3 | 450 | 2.76 HBr | 8.8 | 70 | 257 | 26 | 59 | 33 |
| 4 | 450 | 3.06 HI | 5.82 | 65 | 212 | 18 | 70 | 17 |
| 5 | 450 | 3.42 HCl | 24.30 | 85 | 210 | 20 | 89 | 18 |
| 6 | 450 | 0.50 HBr | 1.55 | 90 | 207 | 22 | 101 | 20 |
| 7 | 450 | 0.50 HI | 0.98 | 90 | 194 | 17 | 103 | 13 |
| 8 | 450 | 0.50 HCl | 3.43 | 100 | 169 | 22 | 134 | 11 |
| 9 | 500 | 0.50 HCl | 3.43 | 85 | 198 | 13 | 96 | 10 |
| 10 | 500 | 0.50 HBr | 1.55 | 80 | 232 | 13 | 75 | 15 |
| 11 | 500 | 0.50 HI | 0.98 | 90 | 210 | 11 | 95 | 10 |
| 12 | 500 | 0.35 $FeCl_3$ | 0.54 | 68 | 215 | 12 | 69 | 12 |
| 13 | 500 | None | — | 160 | 198 | 9 | 187 | 7 |

[1]Flux viscosity 337 cSt at 212° F.
[2]From a plot of the log of the softening point as a function of time.
[3]Kinnaird, R. N., Proceeding of the Association of Asphalt Paving Tech. Vol. 26, 174–189 (Feb. 1957).

TABLE II

PILOT PLANT RUNS USING VARIOUS CRUDE SOURCES[1]

| Flux | Run No. | Cat. Wt. % | Air-Blowing Time, Min. | Softening Point, °F. | Pen., dmm 77° F. |
|---|---|---|---|---|---|
| Arabian Light[2] | 14 | 0.50 HBr | 96 | 219 | 24 |
| | 15 | 1.50 HBr | 86 | 221 | 26 |
| | 16 | 0.35 $FeCl_3$ | 79 | 221 | 22 |
| | 17 | None | 172 | 223 | 13 |
| | 18 | 1.12 $H_3PO_4$ | 220 | 221 | 29 |
| Arabian Heavy[3] | 19 | 0.50 HBr | 89 | 222 | 26 |
| | 20 | 1.50 HBr | 86 | 221 | 25 |
| | 21 | 0.35 $FeCl_3$ | 81 | 221 | 23 |
| | 22 | None | 154 | 220 | 15 |
| | 23 | 1.12 $H_3PO_4$ | 105 | 219 | 35 |
| Alaskan North Slope Blend[1] | 24 | 0.50 HBr | 100 | 221 | 24 |
| | 25 | 1.50 HBr | 92 | 219 | 27 |
| | 26 | 0.35 $FeCl_3$ | 100 | 226 | 17 |
| | 27 | 0.35 $FeCl_3$ | 108 | 221 | 19 |
| | 28 | None | 216 | 221 | 10 |
| | 29 | None | 208 | 223 | 11 |
| | 30 | 1.12 $H_3PO_4$ | 249 | 216 | 19 |
| Alaskan North Slope Blend[2] | 31 | 0.50 HBr | 144 | 221 | 21 |
| | 32 | 0.35 HBr | 164 | 220 | 18 |
| | 33 | 0.35 HBr | 139 | 220 | 16 |
| | 34 | 0.35 $FeCl_3$ | 118 | 226 | 17 |
| | 35 | 0.35 $FeCl_3$ | 108 | 237 | 16 |
| | 36 | None | 190 | 216 | 12 |
| | 37 | None | 197 | 223 | 11 |

[1]Air-blowing temperature = 450° F.
[2]Flux viscosity 658 cSt. at 212° F.
[3]Flux viscosity 937 cSt. at 212° F.
[4]Flux viscosity 329 cSt. at 212° F.
[5]Flux viscosity 337 cSt. at 212° F.

TABLE III

CALCULATED PARAMETERS FOR PILOT PLANT RUNS

| Flux | Run No. | Cat. Wt. % | Calculated for a 220° F. Softening Point: Pen. 77° F. dmm[1] | Calculated for a 220° F. Softening Point: Rx Time[2] Min. |
|---|---|---|---|---|
| Arabian Light | 14 | 0.50 HBr | 24 | 96 |
| | 15 | 1.50 HBr | 26 | 86 |
| | 16 | 0.35 $FeCl_3$ | 23 | 79 |
| | 17 | None | 14 | 168 |
| Arabian Heavy | 19 | 0.50 HBr | 26 | 88 |
| | 20 | 1.50 HBr | 25 | 85 |
| | 21 | 0.35 $FeCl_3$ | 23 | 80 |
| | 22 | None | 15 | 153 |
| Alaskan North Slope | 24 | 0.50 HBr | 24 | 99 |
| | 25 | 1.50 HBr | 27 | 92 |

TABLE III-continued

CALCULATED PARAMETERS FOR PILOT PLANT RUNS

| Flux | Run No. | Cat. Wt. % | Calculated for a 220° F. Softening Point: Pen. 77° F. dmm[1] | Calculated for a 220° F. Softening Point: Rx Time[2] Min. |
|---|---|---|---|---|
| Blend[1] | 26 | 0.35 $FeCl_3$ | 18 | 98 |
| | 27 | 0.35 $FeCl_3$ | 19 | 107 |
| | 28 | None | 10 | 215 |
| | 29 | None | 11 | 204 |
| Alaskan North Slope Blend[2] | 30 | 0.50 HBr | 21 | 143 |
| | 31 | 0.35 HBr | 18 | 164 |
| | 32 | 0.35 HBr | 16 | 139 |
| | 33 | 0.35 $FeCl_3$ | 18 | 116 |
| | 34 | 0.35 $FeCl_3$ | 19 | 103 |
| | 35 | 0.35 $FeCl_3$ | 13 | 111 |
| | 36 | None | 11 | 192 |
| | 37 | None | 11 | 194 |

[1]See note [3] Table I
[2]See note [2] Table I

What is claimed is:

1. An asphalt composition for air-blowing consisting of a catalytic amount of hydrohalic acid, and asphalt in an amount to equal 100 weight percent.

2. The composition according to claim 1 wherein said catalytic amount is from about 0.15 to about 5.0 weight percent of said composition.

3. The composition according to claim 2 wherein the catalytic amount of the hydrohalic acid is from about 0.25 to about 2.5 weight percent of said composition.

4. An asphalt composition according to claim 1 wherein the hydrohalic acid is selected from the group consisting of hydrochloric acid, hydrobromic acid and hydriodic acid.

5. A composition according to claim 4 wherein the hydrohalic acid is hydrobromic acid.

6. A process for producing air-blown asphalt which comprises air blowing an asphalt in the presence of a catalyst consisting essentially of from about 0.15 weight percent to about 5.0 weight percent hydrohalic acid for a sufficient time to obtain a preselected softening point, said hydrohalic acid being mixed with said asphalt prior to air blowing of said asphalt.

7. A process according to claim 6 wherein the hydrohalic acid is present in an amount of from about 0.25 to about 2.5 weight percent.

8. The process according to claim 7 wherein the asphalt is maintained at a temperature in the range of 300° F. to 600° F. while being air-blown.

9. The process according to claim 8 wherein the asphalt is maintained at a temperature in the range of 350° F. to 500° F.

10. The process according to claim 9 wherein the air blowing is carried on for a period from about 0.5 to about 5 hours.

11. The process according to claim 9 wherein the hydrohalic acid is added to the asphalt prior to air blowing in an aqueous solution.

12. The process according to claim 6 or 11 wherein the hydrohalic acid is selected from the group consisting of hydrochloric acid, hydrobromic acid and hydriodic acid.

13. The process according to claim 12 wherein the hydrohalic acid is hydrobromic acid.

14. A process according to claim 6 or 11 wherein the preselected softening point is from about 215° F. to about 235° F., and the asphalt has a resulting penetration measured at 77° F. of about 15 to about 30 dmm.

15. The air-blown asphalt composition of claim 6, said air-blown asphalt having a softening point from 115° F. to 240° F. and a penetration measured at 77° F. of 10 to 90 dmm.

16. The air-blown asphalt composition of claim 15 wherein the composition has a softening point from about 215° F. to about 235° F. and a penetration measured at 77° F. of about 15 to about 30 dmm.

17. A process for producing air-blown asphalt which comprises air blowing an asphalt in the presence of a catalyst consisting essentially of from about 0.15 weight percent to about 5.0 weight percent of hydrobromic acid for a sufficient time in the range of 0.5 to about 5 hours to obtain a preselected softening point of from 115 to 240 degrees Fahrenheit, said hybrobromic acid being mixed with said asphalt prior to air blowing of said asphalt and wherein said asphalt is maintained at a temperature in the range of 300 to 600 degrees Fahrenheit while being air blown, said air being blown through said asphalt at a rate of from about 2 to about 15 cubic feet/hour/gal of asphalt.

* * * * *